US012209840B1

(12) United States Patent
Simon

(10) Patent No.: US 12,209,840 B1
(45) Date of Patent: Jan. 28, 2025

(54) PISTOL GRIP PANEL RETENTION SYSTEM

(71) Applicant: Kimber IP, LLC, Troy, AL (US)

(72) Inventor: John B. Simon, Troy, AL (US)

(73) Assignee: KIMBER IP, LLC, Troy, AL (US)

( * ) Notice: Subject to any disclaimer, the term of this patent is extended or adjusted under 35 U.S.C. 154(b) by 96 days.

(21) Appl. No.: 18/221,231

(22) Filed: Jul. 12, 2023

(51) Int. Cl.
*F41C 23/10* (2006.01)

(52) U.S. Cl.
CPC ..... *F41C 23/10* (2013.01)

(58) Field of Classification Search
CPC ..... F41C 23/10; F41C 23/16
See application file for complete search history.

(56) References Cited

U.S. PATENT DOCUMENTS 984,519 A 2/1911 Browning
5,465,520 A * 11/1995 Cupp ..... F41C 23/10 42/71.02
9,777,984 B1 * 10/2017 Bonine ..... F41C 23/10
10,054,391 B1 * 8/2018 Lyman ..... F41A 3/66
10,731,936 B1 * 8/2020 Sapio ..... F41A 11/00
11,320,234 B1 * 5/2022 Simon ..... F41A 17/20

* cited by examiner

*Primary Examiner* — J. Woodrow Eldred
(74) *Attorney, Agent, or Firm* — Kaplan Breyer Schwarz LLP

(57) ABSTRACT

A firearm having a pistol grip panel retention system is provided, including a frame to receive grip panels. The frame has grip offset surfaces to receive the grip panels. The grip offset surfaces have forward frame undercuts. The frame and grip panels have fasteners to secure the panels to the frame. The grip panels have forward grip undercuts facing a trigger side of the frame to receive a forward frame undercut disposed on the sides of the frame. Each forward grip undercut engages the corresponding forward frame undercut by seating each grip panel in its grip offset surface and translating each grip panel toward the trigger side of the frame. Buffers are disposed between the forward frame undercut and the forward grip undercut. Each grip panel is inserted into a grip offset surface and translated forward to an engagement position.

3 Claims, 7 Drawing Sheets

PISTOL GRIP PANEL RETENTION SYSTEM

BACKGROUND OF THE INVENTION

The present invention is directed to grips for a firearm. More particularly, this invention is directed to firearm handgun-style grips that are removable and replaceable.

Grips for firearms such as handguns and other pistols have been in use essentially since firearms were invented. Firearms having removable and therefore interchangeable grips have also likely been available for nearly as long. See, for example, the patent for the original 1911-style pistol (U.S. Pat. No. 984,519 (Browning)) which shows the commonly seen screw-on style grips where separate grip panels are secured to the pistol frame by pairs of screws visible on the outer surfaces of the grip panels.

It is often desirable for handguns to feature removable and interchangeable grip panels to suit different ergonomics, styles, and aesthetics. Such an interchangeable system would need to allow for grip panels that are relatively easy to install, do not loosen to a noticeable extent with use that would affect a user's secure grip on the firearm, or diminish a customer's perception of quality. A challenge to grip designs that are retained simply with screws are that screws can become loose with use of the firearm due to recoil. An application of a liquid applied thread locking solution (such as Loctite® brand) can mitigate this issue, but at the expense of possible difficulty later upon attempted removal of the screws, including damage to screw heads, as well as there being limited times that screws can be re-used without reapplying additional thread locker.

It would be beneficial to provide an interchangeable grip pattern that limits movement of the grip panel relative to the frame of the firearm and to avoid loosening of the screw or other fastener retaining the grip panel.

All references cited herein are incorporated herein by reference in their entireties.

SUMMARY OF THE INVENTION

In an exemplary embodiment of the present invention, a firearm having a pistol grip panel retention system is provided. The firearm includes a firearm frame that receives a pair of grip panels. The frame includes a handle portion having a left side, a right side, a backstrap side, a trigger side, and a bottom side. The left side and the right side of the handle portion each have a grip offset surface to receive one of the pair of grip panels. Each grip offset surface has a trigger side edge, and each grip offset surface has a forward frame undercut on the corresponding trigger side edge. At least one aperture is disposed on the frame to receive a fastener in each of the left side and the right side of the handle portion of the frame. The fastener is to secure each grip panel to the frame. Each grip panel has an outer side and a frame side. The frame side has a forward grip undercut. The forward grip undercuts face the trigger side of the frame. Each forward grip undercut receives one of the corresponding forward frame undercuts disposed on each of the left side and the right side of the handle portion. Each forward grip undercut engages the corresponding forward frame undercut by seating each grip panel in its grip offset surface and translating each grip panel toward the trigger side of the handle portion of the frame. At least one buffer is disposed between the forward frame undercut and the forward grip undercut. At least one aperture is disposed in the grip panel is for receiving a fastener. Each grip panel is inserted into its corresponding grip offset surface in the frame and translated forward to an engagement position. The fastener secures the grip panels to the handle portion of the frame.

The grip fastener may include a screw, wherein a threaded aperture is disposed on each of the left side and the right side of the handle portion of the frame. Alternatively, the grip fastener may include a screw and an insert, wherein the insert is disposed on each of the left side and the right side of the handle portion of the frame, and the insert has a threaded aperture to receive the screw.

DETAILED DESCRIPTION

The present invention utilizes compliant buffers along with a dovetail configuration for grip panel to frame connection to provide a buffer interference fit, thereby limiting movement of the grip panel, and taking up clearance between the grip panels and frames due to necessary feature size tolerances needed to ensure parts always assemble without the need for manual modification or "fitting."

Figure 1:
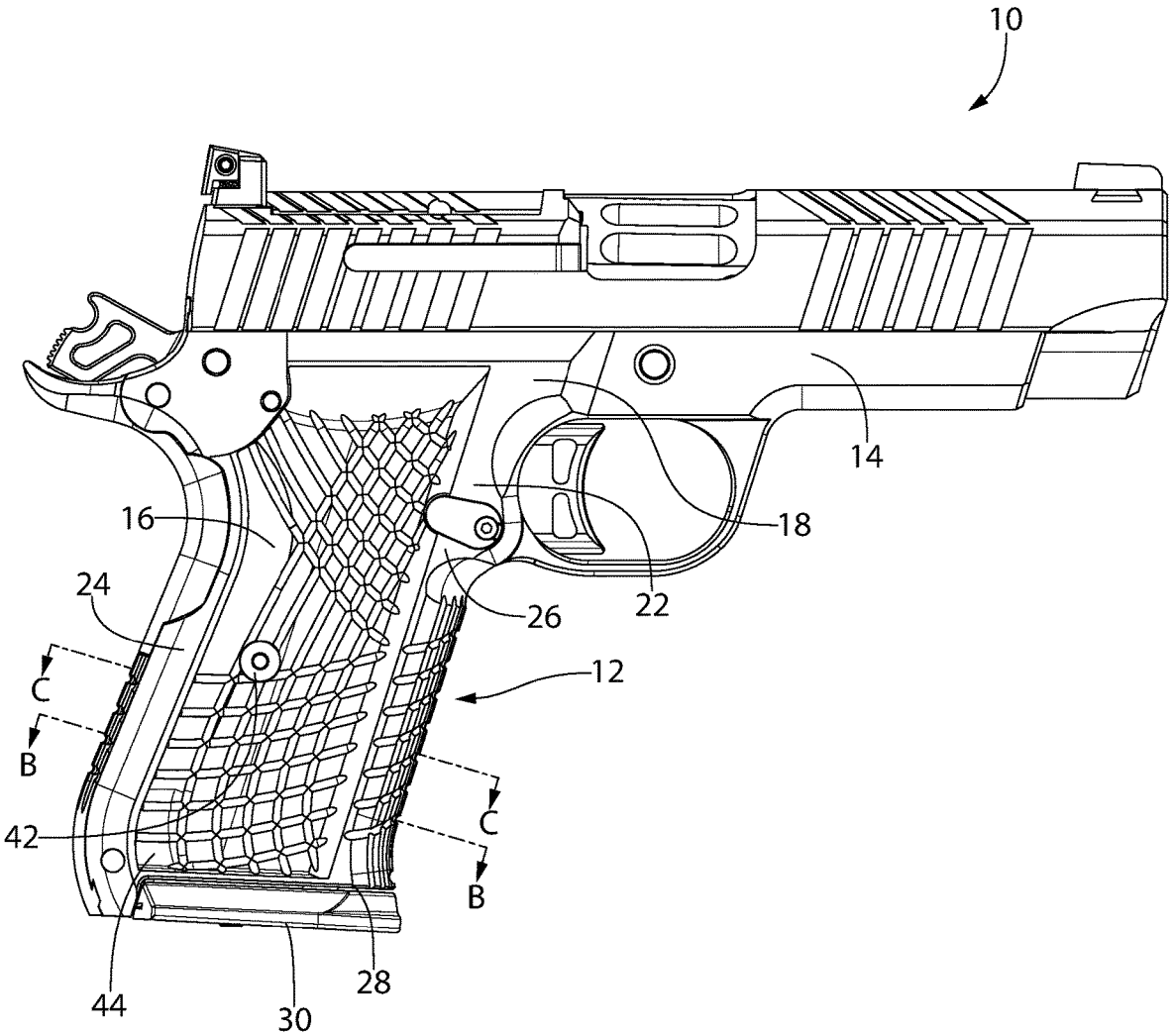
FIG. 1 is a right side elevation view of a firearm having a pistol grip panel retention system in accordance with an exemplary embodiment of the present invention.
Figure 2:
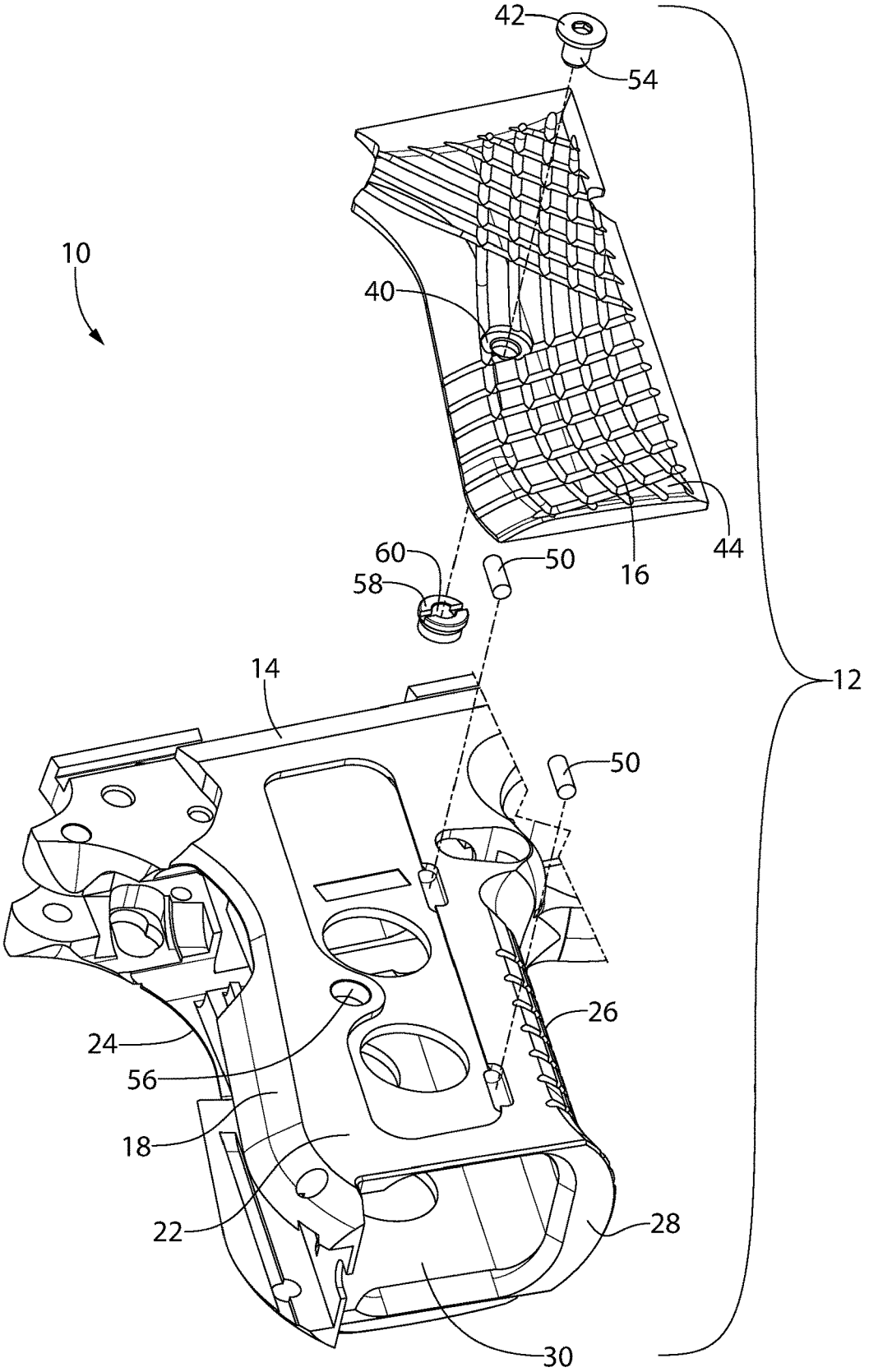
FIG. 2 is a partial, exploded right side isometric view of a frame, grip panels, buffers, fastener, insert and screw for the firearm having the pistol grip panel retention system of FIG. 1.
Figure 4:
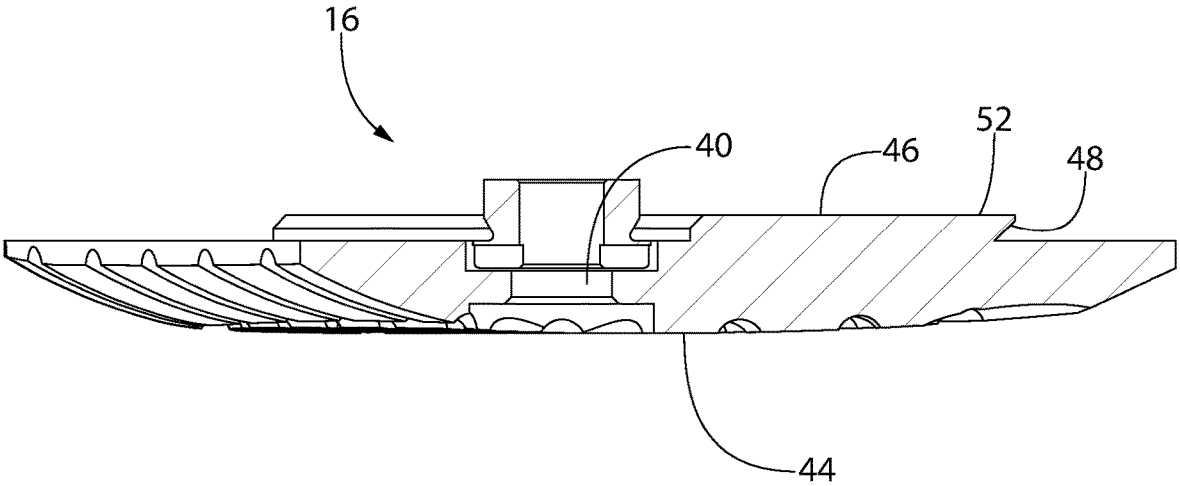
FIG. 4 is a cross-sectional view of the right-side grip panel of FIG. 3, taken substantially along A-A of FIG. 3.
Figure 5:
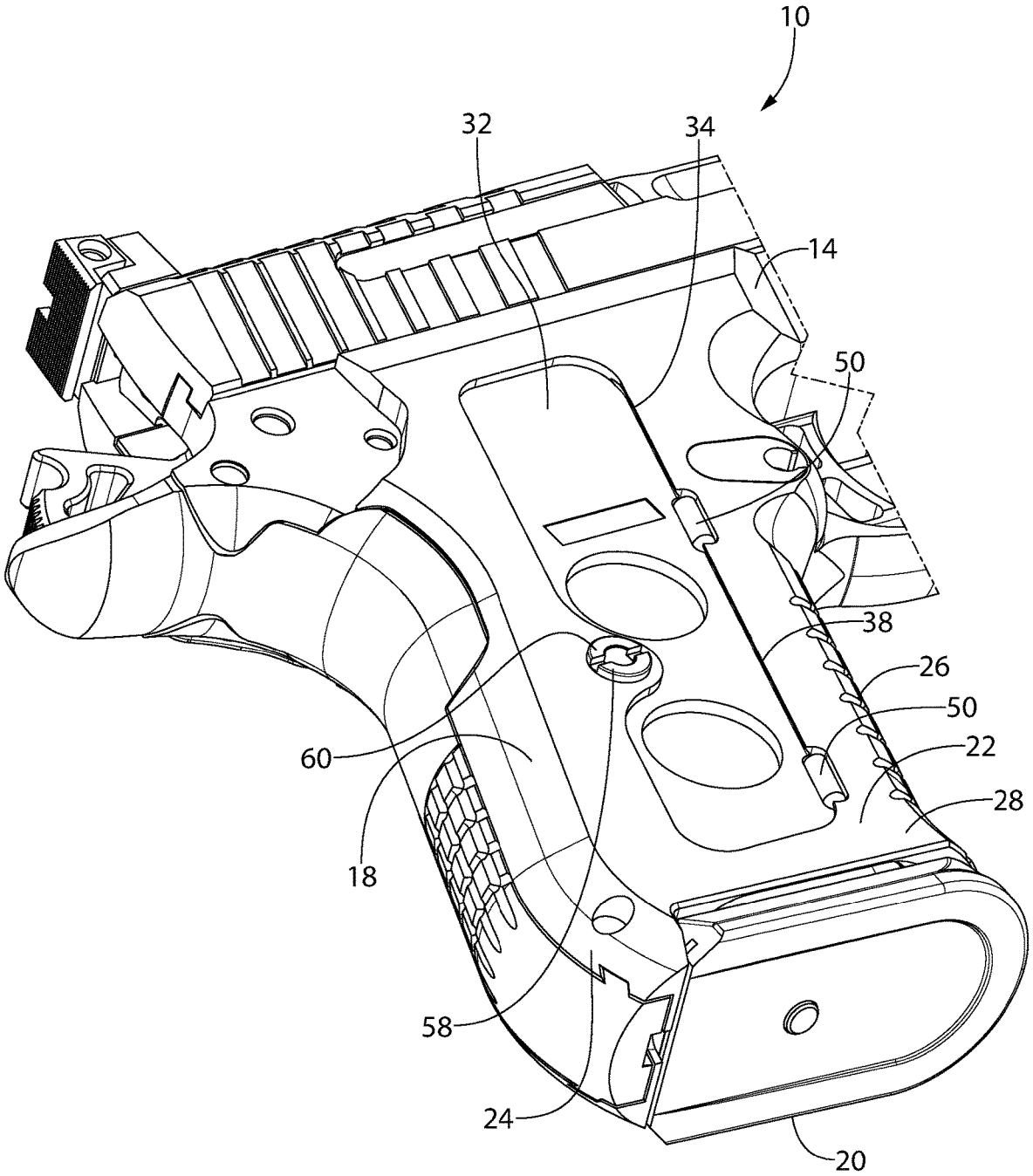
FIG. 5 is a partial, right side isometric view of the firearm having the pistol grip panel retention system of FIG. 1, shown with certain components and grip panel removed for clarity.
Figure 7:
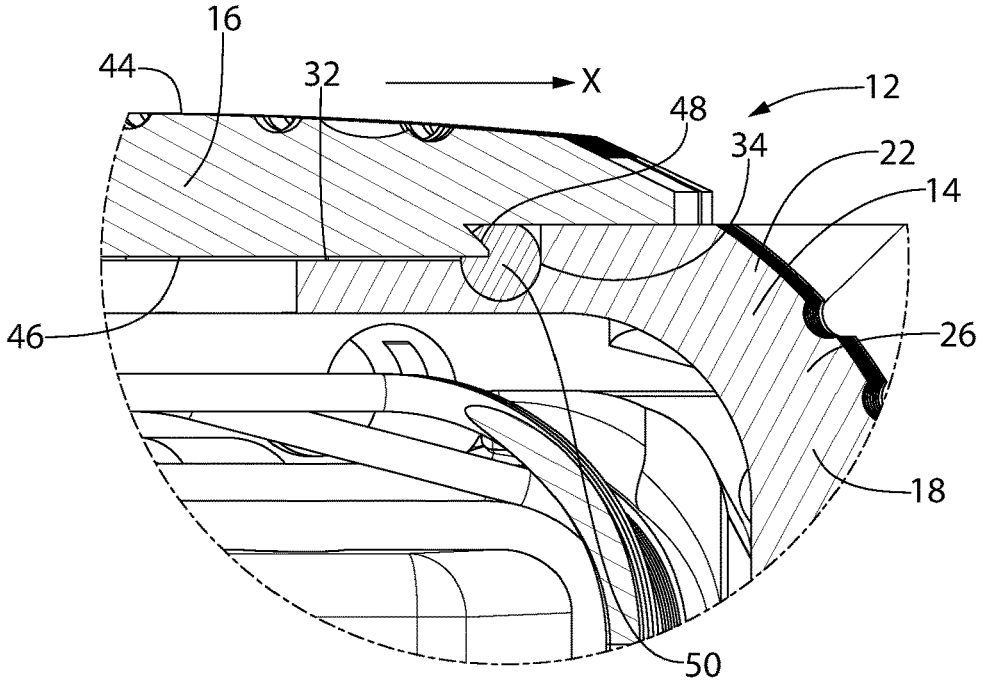
FIG. 7 is a partial cross-sectional view of a firearm having the pistol grip panel retention system of FIG. 1, taken along lines B-B of FIG. 1.
Figure 8:
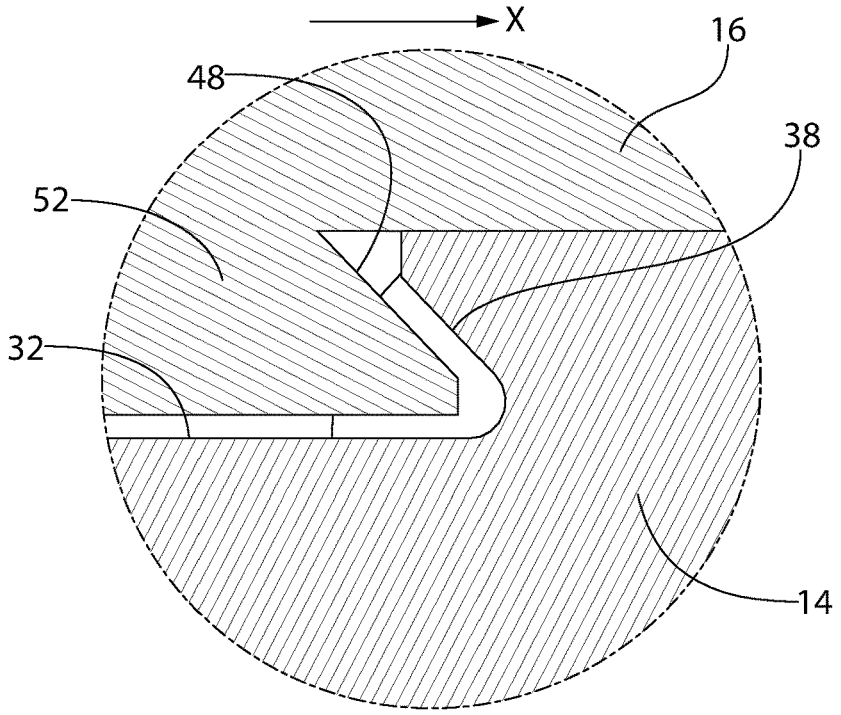
FIG. 8 is an enlarged cross-sectional view of the firearm having the pistol grip panel retention system of FIG. 1, taken along lines C-C of FIG. 1, showing an enlarged partial view with mating undercuts.

Referring now to the drawing figures wherein like reference number refer to like elements throughout the several views, there is shown in FIGS. 1, 2 and 5 a firearm 10 having a pistol grip panel retention system 12 in accordance with an exemplary embodiment of the present invention. As can be further seen in FIGS. 4, 7 and 8, the grip panel retention system includes a firearm frame 14 that is adapted to receive a pair of grip panels 16.

Figure 3:
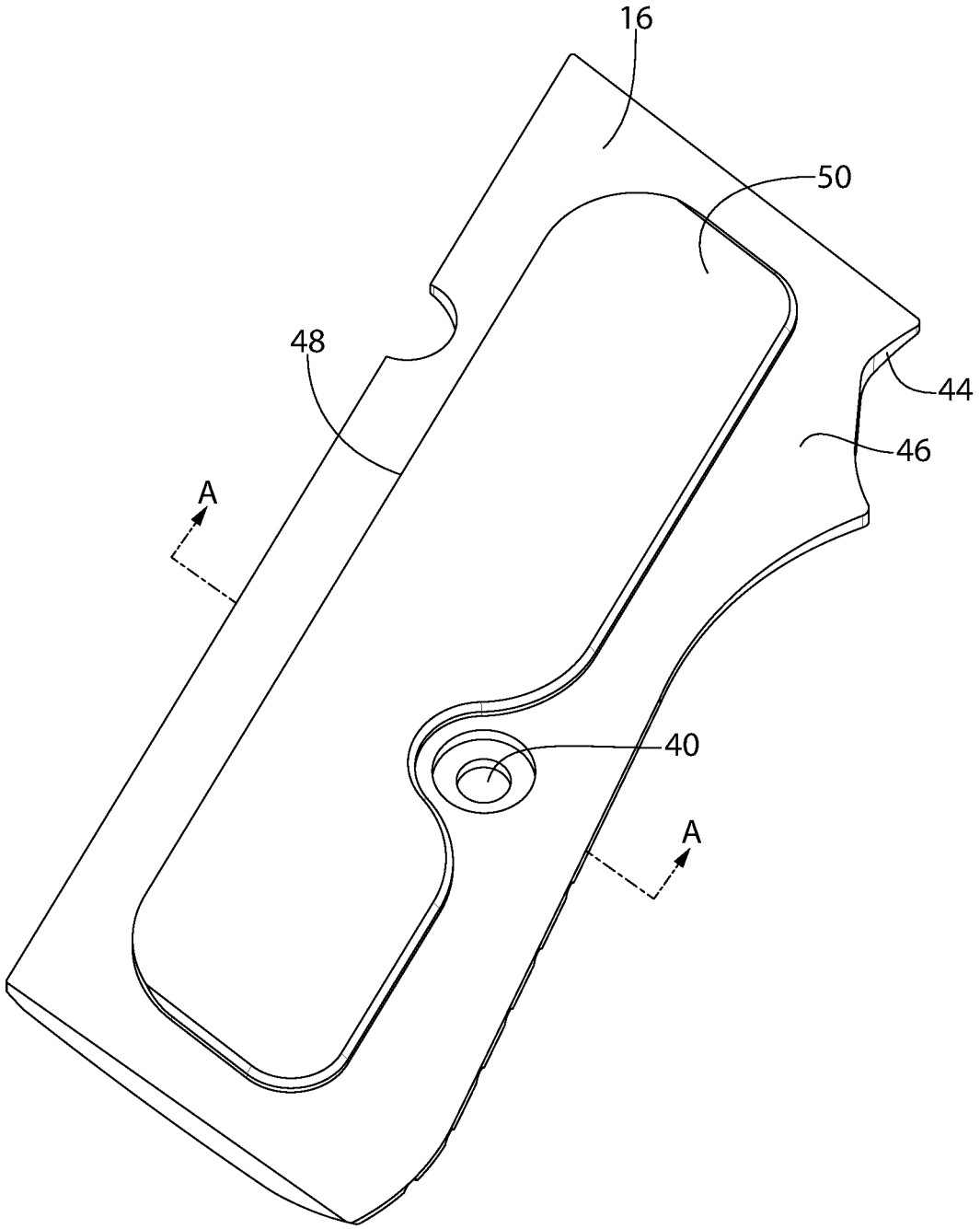
FIG. 3 is a rear isometric view of a right-side grip panel of the firearm having the pistol grip panel retention system of FIG. 1.
Figure 6:
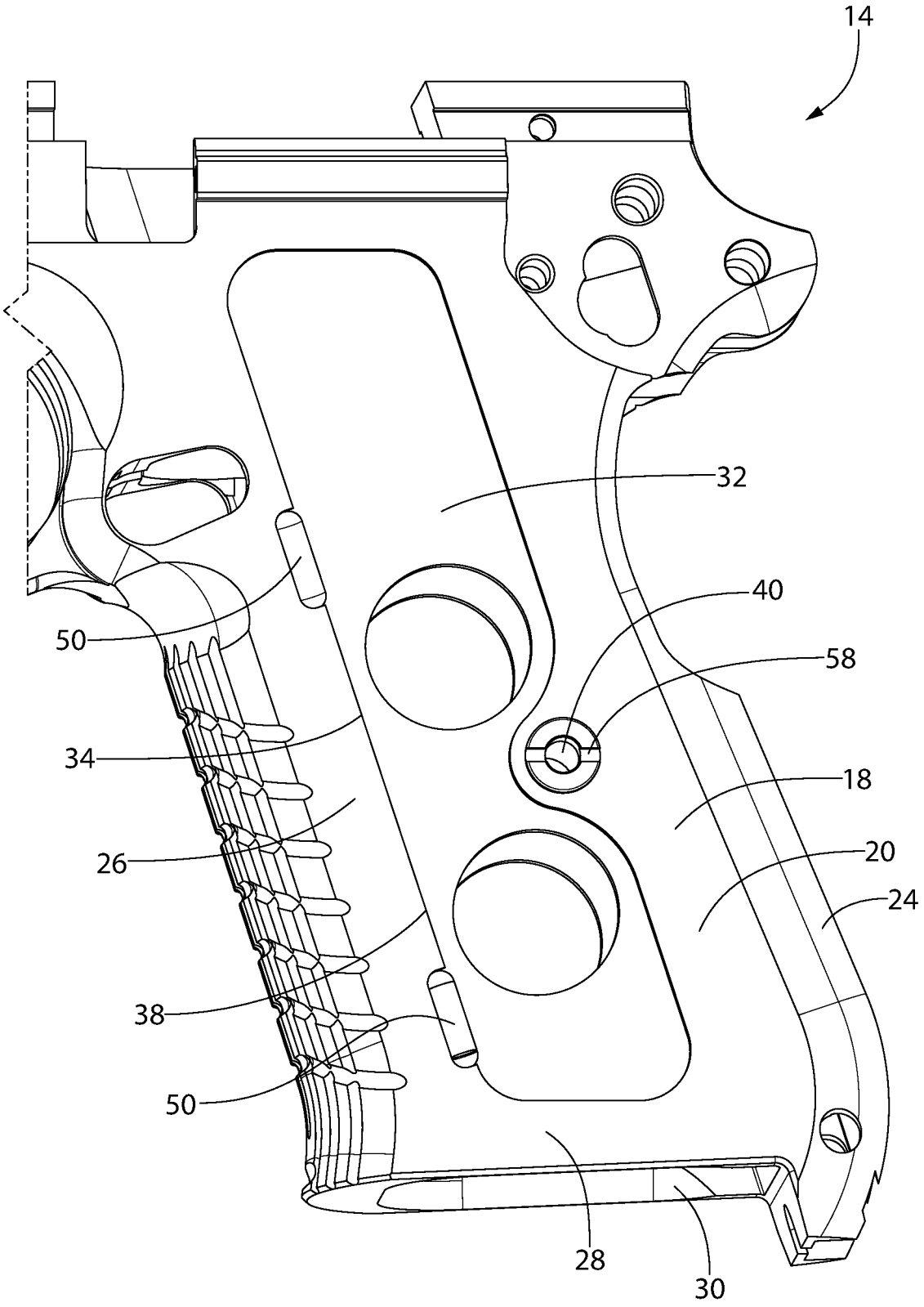
FIG. 6 is a partial left side isometric view of the frame for the firearm having the pistol grip panel retention system of FIG. 1, shown with certain additional components.

As best seen in FIGS. 2, 5 and 6, the frame 14 includes a handle portion 18 having a left side 20, a right side 22, a backstrap side 24, a trigger side 26, a bottom side 28 and a magazine well 30. The left side 20 and the right side 22 of the handle portion 18 each having a grip offset surface 32 to receive one of the pair of grip panels 16 (see FIGS. 3 and 4). Each grip offset surface 32 has a trigger side edge 34. Each grip offset surface 32 also has a forward frame undercut 38 on the corresponding trigger side edge 34, extending at least partially along the corresponding trigger side edge 34.

At least one aperture 40 to receive a fastener 42 (described below) is disposed on each of the left side 20 and the right side 22 of the handle portion 18 of the frame 14. The fasteners 42 secure the grip panels 16 to the frame 14.

Each grip panel 16 has an outer side 44 and a frame side 46. The frame side 46 of each grip panel 16 has a protuberance 50 that engages the grip offset surface 32 of the frame 14, the protuberance 50 having a forward grip undercut 48 facing the trigger side 26 of the frame 14. Each forward grip undercut 48 receives one of the corresponding forward frame undercuts 38 disposed on each of the left side 20 and the right side 20 of the handle portion 18 of the frame 14. Each forward grip undercut 48 of the grip panel 16 engages the corresponding forward frame undercut 38 of the frame by seating each grip panel 16 in its grip offset surface 32 and translating each grip panel 16 within the frame 14 toward the trigger side 26 of the handle portion 18 of the frame 14. See FIGS. 7 and 8.

At least one buffer 50 is disposed between the forward frame undercut 38 and the forward grip undercut 48 to help secure the grip panel 16 to the handle portion 18 of the frame 14.

In assembling the grip panels 16 to the handle portion of the frame 18, each grip panel 16 is inserted into its corresponding grip offset surface 32 in the handle portion 18 of the frame 14 and is translated forward (direction X) slightly to an engagement position (see FIGS. 7 and 8) where the undercuts 38 and 48 mate, wherein the fasteners 42 secure the grip panels 16 to the handle portion 18 of the frame 14.

The grip fasteners 42 each may include is a screw 54 disposed in a threaded aperture 56 disposed on each of the left side 20 and the right side 22 of the handle portion 18 of the frame 14. Alternative, the grip fasteners 42 may comprise a screw 54 disposed in an insert 58, wherein the insert 58 is disposed on each of the left side 20 and the right side 22 of the handle portion 18 of the frame 14. Here, the insert 58 has a threaded aperture 60 to receive the screw.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A firearm having a pistol grip panel retention system, comprising:

(a) a firearm frame to receive a pair of grip panels, the frame comprising
  (i) a handle portion having a left side, a right side, a backstrap side, a trigger side, and a bottom side;
  (ii) the left side and the right side of the handle portion each having a grip offset surface to receive one of the pair of grip panels, each grip offset surface having a trigger side edge, each grip offset surface having a forward frame undercut extending at least partially along corresponding trigger side edge;
  (iii) at least one aperture to receive a fastener in each of the left side and the right side of the handle portion of the frame, the fastener to secure each grip panel to the frame (b) each grip panel having an outer side and a frame side, the frame side having a protuberance having a forward grip undercut, the forward grip undercuts facing the trigger side of the frame, each forward grip undercut to receive one of the corresponding forward frame undercuts disposed on each of the left side and the right side of the handle portion, wherein each forward grip undercut engages the corresponding forward frame undercut by seating each grip panel in its grip offset surface and translating each grip panel toward the trigger side of the handle portion of the frame;

(c) at least one compliant buffer disposed between the forward frame undercut and the forward grip undercut, the compliant buffer compressing to secure the grip panel to the frame;

wherein, each grip panel is inserted into its corresponding grip offset surface in the frame and translated forward to an engagement position, and wherein the fastener to secure the grip panels to the handle portion of the frame.

2. The firearm having a pistol grip panel retention system of claim 1, wherein the grip fastener comprises is a screw and wherein a threaded aperture is disposed on each of the left side and the right side of the handle portion of the frame.

3. The firearm having a pistol grip panel retention system of claim 1, wherein the grip fastener comprises a screw and an insert, wherein the insert is disposed on each of the left side and the right side of the handle portion of the frame, the insert having a threaded aperture to receive the screw.

* * * * *